US005231936A

United States Patent [19]

Kikuchi et al.

[11] Patent Number: 5,231,936

[45] Date of Patent: Aug. 3, 1993

[54] APPARATUS FOR DRYING AND BURNING HIGH-HYDROUS COMBUSTIBLE SOLIDS

[75] Inventors: Takashi Kikuchi, Sendai; Shoji Sakurai, Miyagi; Ikurou Shisido, Sendai; Touru Yoshida, Sendai; Hideo Seki, Sendai; Shinya Watanabe, Sendai, all of Japan

[73] Assignees: Miyagi Ken; Takahashi Syokuhin Kogyo Kabushiki Kaisha; Kabushikikaisha Kameyamatekoshi, Miyagi, Japan

[21] Appl. No.: 932,743

[22] Filed: Aug. 25, 1992

Related U.S. Application Data

[63] Continuation of Ser. No. 598,701, filed as PCT/JP89/01023, Oct. 4, 1989, abandoned.

[30] Foreign Application Priority Data

Mar. 30, 1989 [JP] Japan ..... 1-79339

[51] Int. Cl.[5] ..... F23J 3/00

[52] U.S. Cl. ..... 110/224; 110/225; 110/226; 110/234

[58] Field of Search ..... 110/224, 225, 226, 233, 110/234

[56] References Cited

U.S. PATENT DOCUMENTS

| | | | |
|---|---|---|---|
| 2,026,969 | 1/1936 | Flynn | 110/224 |
| 2,032,402 | 3/1936 | Colby et al. | 110/224 |
| 2,148,447 | 2/1939 | Dundas et al. | 110/224 |
| 4,121,524 | 10/1978 | Voelskow et al. | 110/222 |
| 4,628,833 | 12/1986 | O'Hagan et al. | 110/224 |
| 4,846,082 | 7/1989 | Marangoni | 110/234 |
| 4,848,249 | 7/1989 | LePori et al. | 110/234 |
| 4,878,441 | 11/1989 | Ryham | 110/224 |
| 4,881,473 | 11/1989 | Skinner | 110/224 |
| 4,938,155 | 7/1990 | Williams | 110/221 |
| 5,018,456 | 5/1991 | Williams | 110/222 |

*Primary Examiner*—Henry C. Yuen

*Attorney, Agent, or Firm*—Cushman, Darby & Cushman

[57] ABSTRACT

This invention is an apparatus for drying and burning high-hydrous combustible solids comprising: a hopper for containing high-hydrous combustible solids; a drier for drying said high-hydrous combustible solids when transported from said hopper to said drier 1; a combustion chamber for receiving and burning dried solid from a transportation tube; and a means to lead the waste gas from said combustion chamber to said drier to be used as drying gas. High-hydrous combustible solids are transported to furnace the combustion chamber immediately after being dried in the drier, and the waste gas from the combustion chamber is used as drying gas in the drier.

1 Claim, 8 Drawing Sheets

APPARATUS FOR DRYING AND BURNING HIGH-HYDROUS COMBUSTIBLE SOLIDS

This is a continuation of application Ser. No. 07/598,701, filed on Oct. 23, 1990, which was filed as PCT/JP89/01023, abandoned.

FIELD OF THE INVENTION

The present invention relates to an apparatus for drying and burning high-hydrous combustible solids or wet wastes, and more particularly to an improvement in or relating to a drying and burning system in which high-hydrous combustible solids such as bean-curd refuse, are put in and dried in an associated drier; the dried solids are brought and burned in an associated furnace; and the hot waste gas is fed from the furnace to the drier to dry the wet waste.

BACKGROUND ART

As is well known, high-hydrous combustible solids or wet wastes such as bean-curd refuse, sewage or raw sewage are treated by dewatering, drying and burning. Specifically, wet waste is subjected to these treatment sequentially in dehydrator, drier and furnace. These processing components separate or independent from each other, not making up a composite or integrated system. In an attempt to meet energy-saving demands or reduce public nuisance, the drier and furnace were combined to provide an integrated system.

Specifically, in such an integrated system, the hot waste gas which is produced when drying the wet waste in the drier, is fed to the furnace to be burned and deodrized. A part of so deodorized gas is fed to the drier, and is used as drying gas. This system constitutes a closed deodorizing system, and is advantageous from the energy saving point of view.

The conventional system, however, dries the wet waste in a drier, and burns the odor gas in a furnace for the sake of deodorizing rather than burning. Therefore, the conventional system requires another furnace for burning the deodorized material to ash. Accordingly, the whole size disadvantageously increases. The deodorizing furnace cannot be used to burn the dried waste because it is connected to the drier by a pipe whose size is only large enough to allow the odor to pass to the furnace, preventing the dried waste from passing to the furnace.

One object of the present invention is to provide an apparatus for drying and burning high-hydrous combustible solids or wet wastes, in which high-hydrous combustible solids are dried in an associated drier, and the dried solids are brought and burned to ash in an associated furnace while the deodorized gas is fed from the furnace to the drier to dry the wet waste therein. Thus, the furnace is used as deodorizing furnace, too.

Another object of the present invention is to provide means for breaking dewatered waste into fragments by blowing air, which is used to carry fragments of dried material to the furnace, thereby increasing the efficiency with which the waste material may be burned in the furnace because of substantially increased surface area of the pulverized waste material. Blown air is also used for expediting combustion in the furnace. Thus, a single blower may be used for transporting dry waste material, breaking the material into fragments and supplying a sufficient amount of air to burn the fragments of waste material in the furnace.

SUMMARY OF THE INVENTION

In order to attain these objects an apparatus for drying and burning high-hydrous combustible solids according to the present invention is characterized in that it comprises: a hopper 20 for containing high-hydrous combustible solids; a drier 1 to receive high-hydrous combustible solids from hopper 20 for drying; a furnace 23 to receive the dewatered combustible solids from drier 1 via pipe 22 for burning; and a means for leading the deodorized gas from furnace 23 to the drier 1, thus permitting use of the deodorized gas as drying gas. A solid-gas separator 26 is provided in dried material transporting conduit 22 between drier 1 and furnace 23. Hopper 20 communicates with solid-gas separator 26 by a duct 39 including blower 38, thereby permitting the air-and-odor gas from the high-hydrous combustible solids in hopper 20 to flow to solid-gas separator 26 via air duct 39 and break there the dewatered combustible solids into fragments, thus increasing the burning efficiency in furnace 23. The air flows out from ejector 27 at the lower part of solid-gas separator 26, transporting the so separated solid material into furnace 23. Also, the air is used as burning air in furnace 23.

Exhaust duct 31, cyclon 32 and subsequent exhaust duct 34 are connected to solid-gas separator 26. Air duct 39 is in the form of branch downstream of blower 38, one branch being connected to solid-gas separator 26 while the other branch being connected to furnace 23 to supply secondary air.

Steam jacket 46 is provided to the circumference of combustion chamber 53 of furnace 23. The steam thus generated by steam jacket 46 can be used in producing any products, and the resulting wet waste can be treated in the drying and burning system.

In operation the wet waste in hopper 20 is dried in drier 1, and then the dried waste is transferred into furnace 23, where it is burned by burner 24, and at the same time, the waste gas is sent to drier 1. Thus, the waste gas is used as drying gas in drier 1.

Thansportation of the dried waste from drier 1 to furnace 23 is described below in detail. The air supplied from blower 38 to solid-gas separator 26, breaks the dried waste into fragments, and then the air causes the ejecting effect on fragments of dried waste at ejector 27, drawing and leading them to furnace 23. Thus, the flowing air blows the dried waste to furnace 23 after breaking into fragments. Accordingly the burning efficiency in furnace 23 will be improved. Also, the air which carries fragments of waste solid, is used for combustion in furnace 23.

The gas separated from the dried solid fragments is solid-gas is separater 26 leaves exhaust duct 34 via exhaust tube 31 and cyclone 32. When blower 38 is put in operation, the air is drawn from hopper 20, and therefore the odor is removed from the wet waste in hopper 20. Also, the flowing air is used as secondary air for expediting combustion in furnace 23. Steam jacket 46 surrounding combustion chamber 53 of furnace 23 generates steam, which may be used in producing any products. In the course of production, wet waste may be left over, which, however, may be disposed by the drying-and-burning system.

DESCRIPTION OF DRAWINGS

The accompanying drawings show one embodiment of the present invention.

Figure 1:
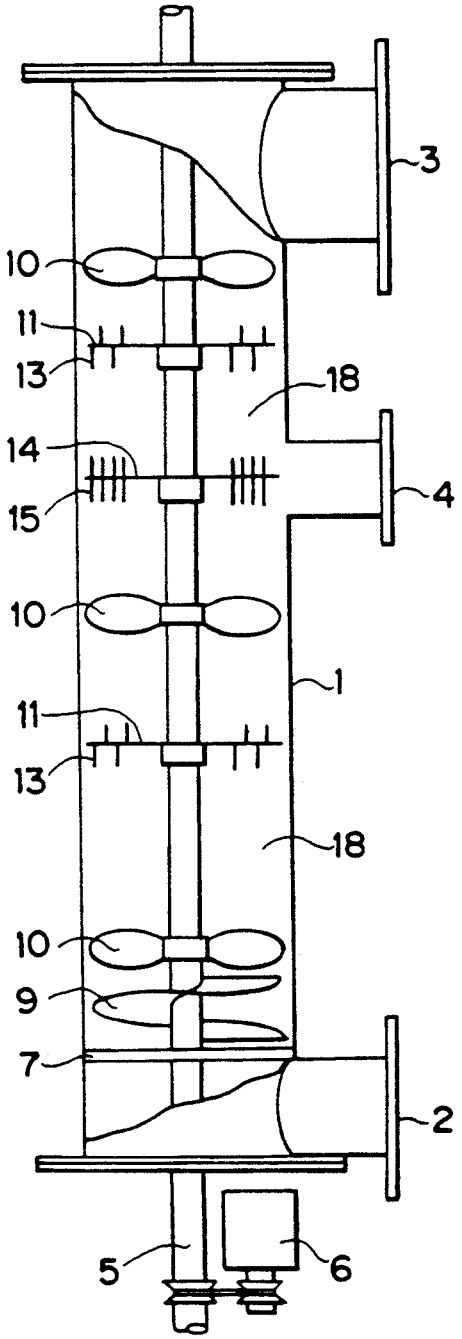
FIG. 1 is a front view of the drier, partly broken to show some essential parts of the drier.
Figure 2:
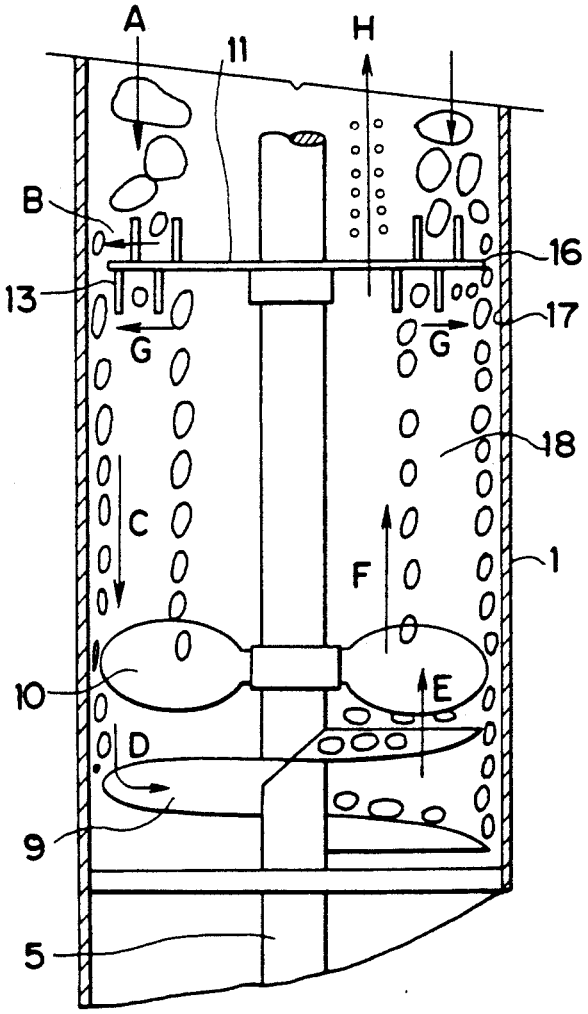
FIG. 2 shows how circular wind motion is used for drying and fracturing.
Figure 3:
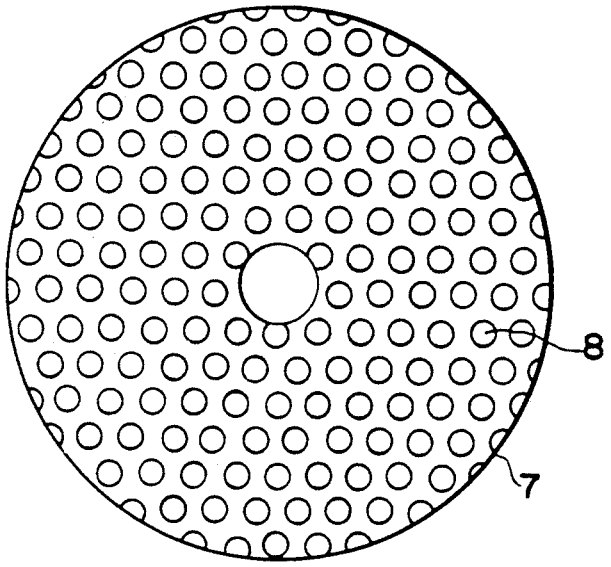
FIG. 3 is a plane view of a perforated distribution plate.
Figure 4:
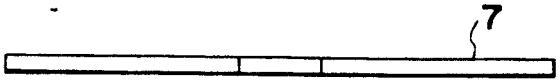
FIG. 4 is a side view of the perforated distribution plate.
Figure 5:
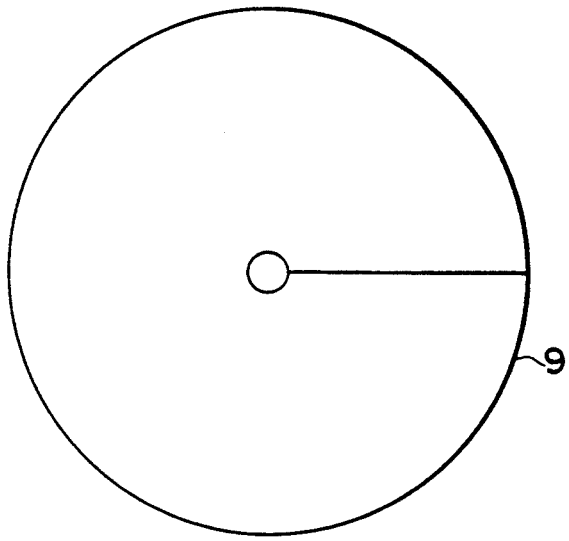
FIG. 5 is a plane view of a screw.
Figure 6:
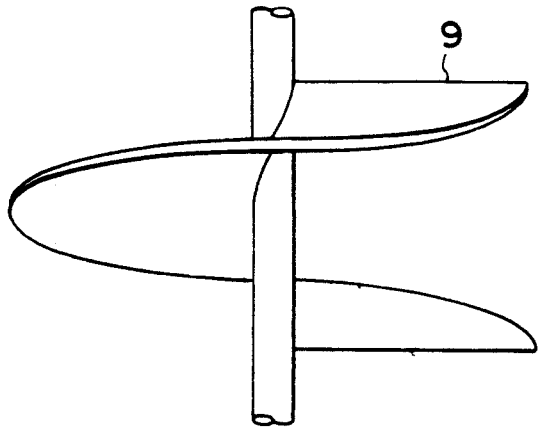
FIG. 6 is a side view of the screw.
Figure 7:
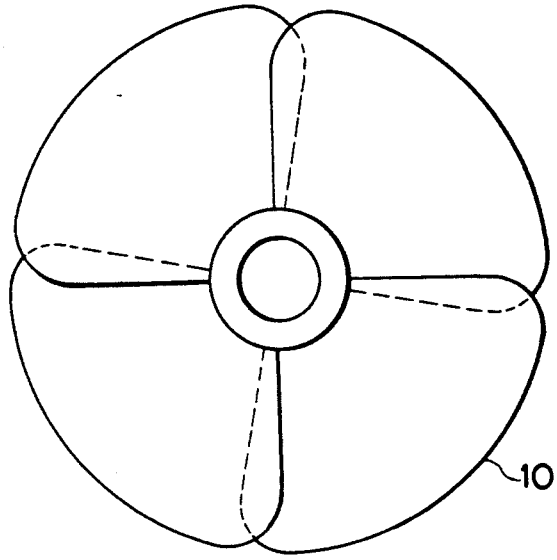
FIG. 7 is a plane view of the blade.
Figure 8:
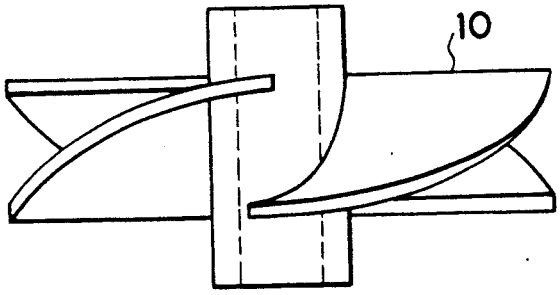
FIG. 8 is a side view of the blade.
Figure 9:
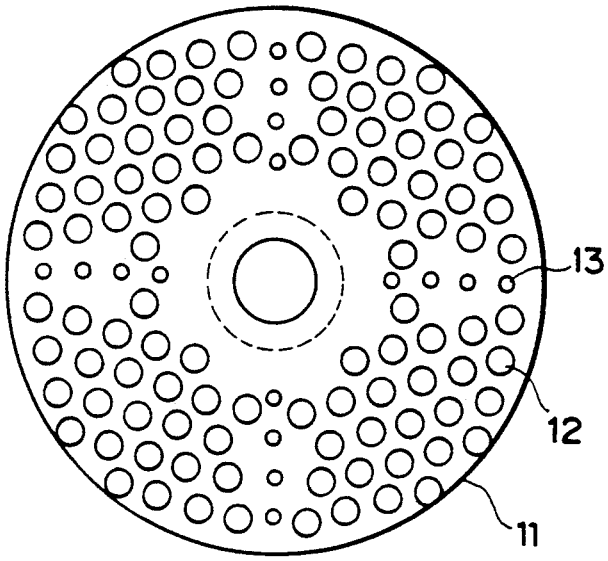
FIG. 9 is a plane view of an obstacle plate.
Figure 10:
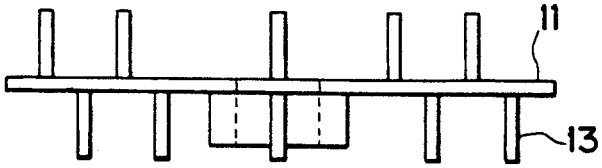
FIG. 10 is a side view of the obstacle plate.
Figure 11:
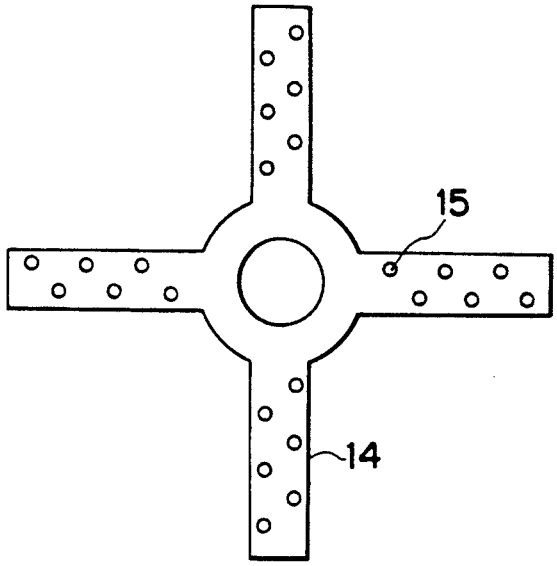
FIG. 11 is a plane view of a fracturing blade.
Figure 12:
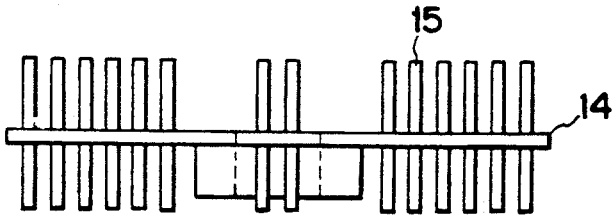
FIG. 12 is a side view of the fracturing blade.

BEST MODE OF CARRYING OUT THE PRESENT INVENTION:

FIGS. 1 to 12 show drier 1 which may be used in the present invention.

A cylindrical drier is indicated at 1, and this drier has gas supplying vent 2 at its lower part; dried waste exhausting opening 3 at its upper part; and wet waste inlet opening 4 at a somewhat higher level than the intermediate level of the cylinder. These openings and vents are arranged longitudinally. Cylindrical drier 1 has rotating shaft 5 along its longitudinal central axis, electric motor 5 is used to rotate shaft 5. Perforated distribution plate 7 is laid adjacent to gas vent 2 at the bottom level of cylindrical drier 1 for distributing hot air. Screw 9 is fixed to rotating shaft 5 above perforated distribution plate 7. Screw 9 is adapted to be rotated by shaft 5. Blade 10 is provided at a higher level than screw 9. Screw 9 and blade 10 are arranged in such positions that dried waste may be brought upward by screw 9, and then may be made to fly by spiral wind motion, which is caused by blade 10.

An obstacle plate 11 is fixed to rotating shaft 5 at a higher level than blade 10. Obstacle plate 11 has small apertures 12 and pins 13 on its opposite surfaces. There is an annular gap between the circumference 16 of obstacle plate 11 and inside surface 17 of cylindrical drier 1. The gap is broad enough to allow pieces of dried waste solid to pass. Circular wind motion zone 18 is defined between obstacle plate 11 and blade 10.

In this particular embodiment there are another combinations of obstacle plate 11 and blade 10 and another circular wind motion zone 18 at a higher level. Also, there is still another blade 10 at a highest level. Inlet 4 for pieces of wet waste opens at the second circular wind motion zone 18, in which fracturing cross blade 14 having fracturing pins 15, is fixed to rotating shaft 5.

Figure 13:
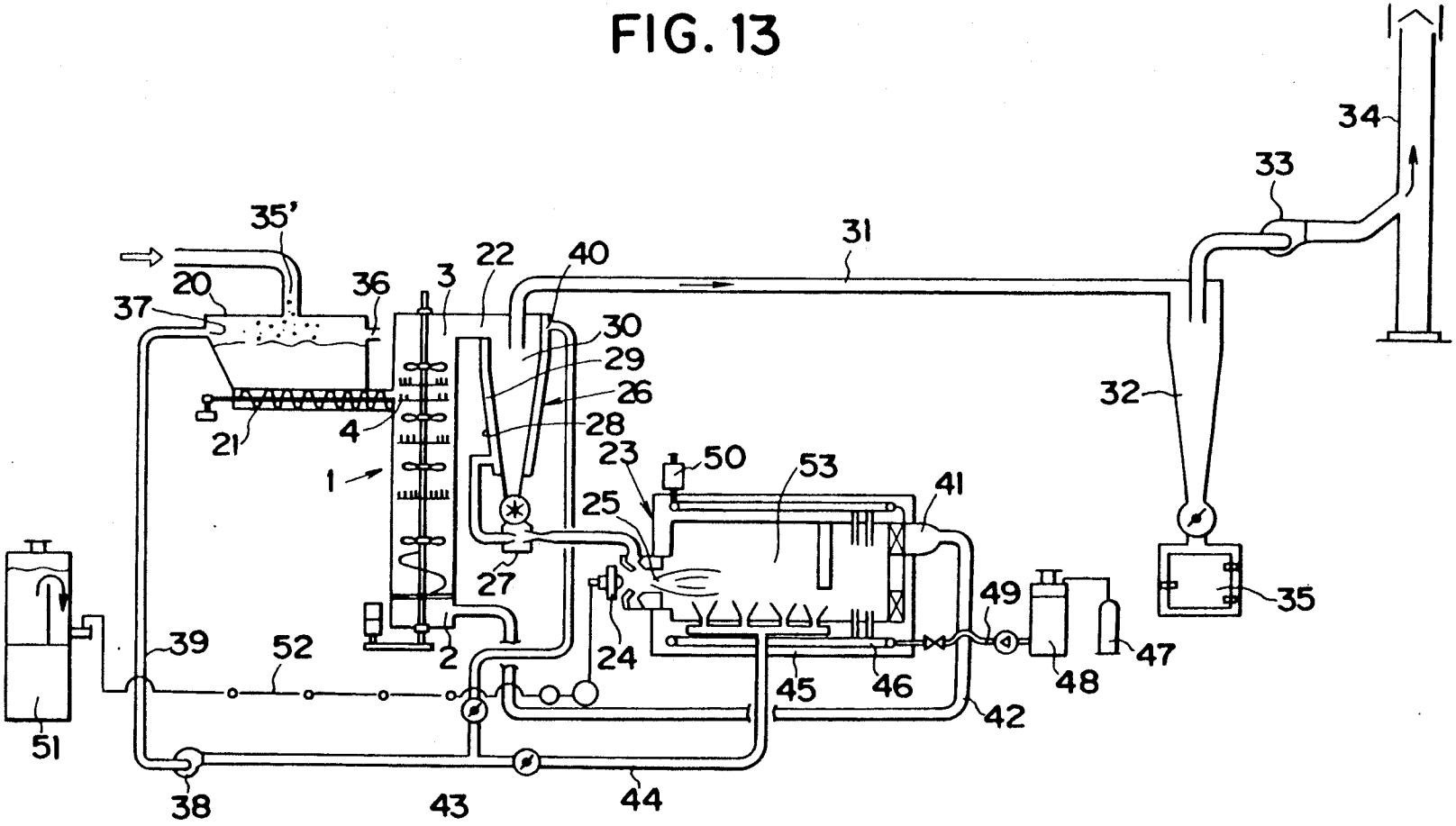
FIG. 13 is a diagramatic view of the drying-and-burning apparatus.

Now, referring to FIG. 13, the whole structure of a drying-and-burning system is described below.

Hopper for containing wet waste is indicated at 20. Hopper 20 communicates with inlet 4 of drier 1 via screw conveyer 21. Exit 3 for discharging fragments of dried waste solid, communicates with furnace 23 via transportation conduit 22. More specifically, exit 3 communicates with the circular wind motion zone 25 of burner 24 in furnace 23 via transportation conduit 22. Solid-gas separator 26 is situated in transportation conduit 22. Specifically, solid-gas separator 26 has transportation conduit 22 at its upper level, and ejector 27 at its lower level. Ejector 27 is connected on its primary side to gas chamber 29, which is provided to side wall 28 of solid-gas separator 26, and ejector 27 is connected on its secondary side to the circular wind motion zone 25 of furnace 23.

Exhaust duct 31 extends from the upper part of the separating space 30 of funnel-shaped solid-gas separator 26, thus permitting ejection of the gas from solid-gas separator 26 through cyclone 32, drawing fan 33 and exhaust duct 34. Dust box 35 is attached to the bottom of cyclone 32.

Hopper 20 is designed to contain high-hydrous combustible solids or wet waste such as bean-curd refuse, and it has inlet 35′ for wet waste on its ceiling, and air inlet 36 on its side. Another inlet 37 of hopper 20 is connected to inlet 40 of solid-gas separator 26 via air duct 39, which has blower 38.

Wastegas outlet 41 of furnace 23 is connected to gas inlet 2 of drier 1 by wastegas return tube 42. Air duct 39 has a secondary air inlet tube 44 extending therefrom in the form of branch 43 downstream of blower 38, and connected to secondary air nozzle 45, which opens in combustion chamber 53. This combustion chamber 53 is surrounded by steam jacket 46, and water supply tank 48 having water softner 47 associated therewith, is connected to steam jacket 46 by water supply tube 49. The steam generated by steam jacket 46 may be used in producing related products. Wasteoil tank 51 is connected to burner 24 by wasteoil supply pipe 52.

The operation of the drying-and-burning system is described below.

High-hydrous combustible solids or wet wastes such as bean-curd refuse are put in hopper 20 from its inlet 35′. Then, wet waste is transported to inlet 4 of drier 1 by screw conveyer 21, and bulks of wet waste are thrown in drier 1 where they are broken into fragments by pins 15 of fracturing blade 14. The fragments of wet waste fall downward. In the course of descent by gravity the fragments of wet waste are struck and sprung upwards by rotating blade 10 on the second stage. While this takes place, the fragments of wet waste is brought in counter contact with rising flow of hot gas, thereby expediting the drying of wet waste. At the outset the fragments of wet waste have relatively high water content, and therefore they are relatively heavy. Thus, they are likely to fall on obstacle plate 11 as indicated by arrows A in FIG. 2 rather than being carried upwards by the rising gas. Rotating obstacle plate 11 has pins 13 thereon, and falling fragments are struck and sprung as indicated by arrow B in FIG. 2 so that they are struck against the inside surface 17 of drier 1, and they fall down along the inside surface 17 of drier 1 in the annular space between the circumference 16 of rotating blade 11 and the inside surface 17 of drier 1. During this process fragments of waste are in contact with hot wind, and accordingly they are being dried all the time. Finally, they fall on rotating screw 9, and then they are sprung up and carried upwards by rising gas. Because of rotating screw 9, gas supply inlet 2 and the apertures of destribution plate 7 cannot be blocked with waste fragments.

As indicated by arrow E in FIG. 2, fragments of waste are transferred to rotating blade 10, and as indicated by arrow F in FIG. 2, again they are sprung up by rotating blade 10. Then, smaller fragments of waste are carried upwards by circular wind motion, which is caused by rotating blade 10. During the process described so far fragment size is reduced gradually, and accordingly the relative surface area of each fragment increases, thus increasing the efficiency with which fragments of waste are brought in contact with gas. Also, as indicated by arrow G, fragments of waste are struck and sprung against the inner surface 17 of drier 1 by pins 13 on the lower surface of obstacle plate 11. Again, fragments of waste are broken and reduced in size. Then, they fall down along the inner surface 17 of drier 1.

Thus, pieces of wet waste material are brought by circular wind motion in zone 18 as indicated by arrows C-D-E-F-G-C until they are broken to small fragments, accordingly increasing the relative surface area of each fragment and expediting the drying of wet waste. Particles of dried solid are carried by hot wind which blows upwards from the apertures 12 of obstacle plate 11. In this particular embodiment particles of dried solid are subjected to same treatment in circular wind motion zone 18 at the second stage, where solid particles are reduced in size, and dried even more. In this second stage the temperature of heated gas lowers somewhat, and the heated gas contains some water. Therefore, heat and water will be deprived with an extremely high efficiency.

Dried particles are struck and sprung by final blade 10, and are carried away by hot wind, leaving exhaust outlet 3.

When blower 38 is driven, air is supplied to the solid-gas separating space 40 of solid-gas separator 26 via inlet 37 of hopper 20 and air duct 39, thus collecting the odor from the inside of hopper 20.

The supplying of air to solid-gas separator permits separation of dried particles into solid and gas, and solid particles are reduced in size. The gas is discharged through air duct 31, cyclone 32 and exhaust duct 34. On the other hand, a part of supplied air is led to ejector 27 via air chamber 29, and pulverized solid waste is drawn and brought to circular wind motion zone 25 of furnace 23, where it is burned by burner 24. The pulverized solid can be burned well because of its small particle size. This combustion is effected by using the air which carries the pulverized solid. In addition the combustion uses the secondary air which is drawn into combustion chamber 53 through secondary air supply conduit 44 branching downstream of blower 38.

Dried particles are burned there, and the waste gas flows back to gas inlet 2 of drier 1 via gas return pipe 42 to be used in drying process.

As may be understood from the above, in the drying-and-burning system according to the present invention the wet waste is dried in drier 1, and then the dried solid is brought to furnace 23, where it is burnt. This permits reduction of the size of the wet waste disposing system in designing. Also, the waste gas from furnace 23 is made to return to drier 1 to be used as drying gas, and accordingly energy is saved. A single blower 38 is used to effect transportation of waste solid from drier 1 to furnace 23, reduction of dried waste solid in size, supply of air for combustion and collection of the odor from the wet waste in hopper 20.

We claim:

1. An apparatus for treating a combustible substance of high water content and an offensive odor containing gas, comprising:

means defining an enclosed chamber for storing said combustible substance with said offensive odor containing gas;

means for feeding said combustible substance and said offensive odor containing gas, said feeding means forcedly introducing air into said storing means for forming a gaseous phase mixture of air and said offensive odor containing gas;

means for separating a solid and gas, said solid/gas separating means having a ventilation passage for ventilation of the separated gas;

means for heating and drying said combustible substance with a heating gas to form dried combustible substance;

means for pulverizing the dried combustible substance in said heating means, said pulverizing means introducing said gaseous phase mixture as a medium for performing pulverization of said dried combustible substance and for carrying said pulverized combustible substance;

means for burning said combustible substance with said carrier gas;

means for introducing an exhaust gas generated in said burning means to said heating means as said heating gas;

an air duct connected to said storage means having a first branch connected to said separator means and a second branch connected to said combustion means to supply additional air to said combustion means;

means for driving air disposed between said storage means and said separator means thereby permitting said driving means to drive air containing an odor resulting from the high-hydrous combustible solids in said storage means into said separator means via said air duct to pulverize dried solids with said air for the purpose of increasing the efficiency with which said combustion means burns said combustible solids, such that said air flowing into said separator means is allowed to flow through an ejector at a bottom of said separator means to transport separated solids to said combustion means wherein the air and solids are combusted;

means for producing steam from said combustion means;

exhaust means for ejecting gas from an upper part of said separator means;

a cyclone connected to said exhaust means through which said gas from said separator flows; and a second exhaust means for ejecting gas from said cyclone.

* * * * *